US006549884B1

(12) United States Patent
Laroche et al.

(10) Patent No.: US 6,549,884 B1
(45) Date of Patent: Apr. 15, 2003

(54) PHASE-VOCODER PITCH-SHIFTING

(75) Inventors: Jean Laroche, Santa Cruz, CA (US); Mark Dolson, Ben Lomond, CA (US)

(73) Assignee: Creative Technology Ltd., Singapore (SG)

( * ) Notice: Subject to any disclaimer, the term of this patent is extended or adjusted under 35 U.S.C. 154(b) by 0 days.

(21) Appl. No.: 09/399,920

(22) Filed: Sep. 21, 1999

(51) Int. Cl.[7] ..... G10L 19/14

(52) U.S. Cl. ..... 704/207; 704/205; 704/229; 704/269; 704/203

(58) Field of Search ..... 704/229, 203, 704/230, 205, 500, 200.1, 269, 268, 220, 207

(56) References Cited

U.S. PATENT DOCUMENTS

| | | | | | |
|---|---|---|---|---|---|
| 5,384,891 | A | * | 1/1995 | Asakawa et al. | 704/230 |
| 5,567,901 | A | * | 10/1996 | Gibson et al. | 84/603 |
| 5,687,240 | A | | 11/1997 | Yoshida et al. | |
| 5,870,704 | A | * | 2/1999 | Laroche | 704/209 |
| 5,890,108 | A | * | 3/1999 | Yeldener et al. | 704/208 |
| 6,073,100 | A | * | 6/2000 | Goodridge, Jr. | 704/258 |
| 6,112,169 | A | | 8/2000 | Dolson | |
| 6,182,042 | B1 | * | 1/2001 | Peevers | 704/269 |

OTHER PUBLICATIONS

Sylvestre et al., ("Time–scale Modification of Speech Using Incremental Time–Frequency Approach with Waveform Structure Compensation," IEEE International Conference on Acoustics, Speech, and Signal Processing, Mar. 23–26, 1992, pp. 81–84).*

Laroche et al., ("Phase vocoder : about this phasiness business," 1997 IEEE Workshop on Applications of Signal Processing to Audio and Acoustics, pp. 1–4, Oct. 1997).*

Laroche et al., ("Improved phase vocoder time–scale modification of audio," IEEE Transactions on Speech and Audio Processing, vol. 7, issue 3, pp. 323–332, may 1999).*

Allen et al. "A Unified Approach to Short–Time Fourier Analysis and Synthesis," Proc. IEEE 65:1558–1564 (1977).

Bershad "Analysis of the Normalized LMS Algorithm with Gaussian Inputs," IEEE Transactions on Acoustics, Speech, and Signal Processing 34:793–806 (1986).

Ferreira "An odd–DFT based approach to time–scale expansion of audio signals," IEEE Transactions on Speech and Audio Processing.7:441–453 (1999).

Flanagan et al. "Phase vocoder," Bell Syst. Tech. J. 45:1493–1509 (1966).

George et al. "Analysis–By–Synthesis/Overlap–Add Sinusoidal Modeling Applied to the Analysis and Synthesis of Musical Tones," J. Audio Eng. Soc. 40:497–516 (1992).

Laakso et al. "Splitting the Unit Delay," IEEE Signal Processing Mag., 13:30–60 (1996).

Laroche "Time and pitch scale modification of audio signals," in *Applications of Digital Signal Processing to Audio and Acoustics*, M. Kahrs and K. Brandenburg eds., Kluwer, Norwell, MA, (1998).

(List continued on next page.)

*Primary Examiner*—Vijay Chawan
(74) *Attorney, Agent, or Firm*—Townsend and Townsend and Crew LLP

(57) ABSTRACT

A system for pitch-shifting an audio signal wherein resampling is done in the frequency domain. The system includes a method for pitch-shifting a signal by converting the signal to a frequency domain representation and then identifying a specific region in the frequency domain representation. The region being located at a first frequency location. Next, the region is shifted to a second frequency location to form a adjusted frequency domain representation. Finally, the adjusted frequency domain representation is transformed to a time domain signal representing the input signal with shifted pitch. This eliminates the expensive time domain resampling stage and allows the computational costs to become independent of the pitch modification factor.

31 Claims, 4 Drawing Sheets

OTHER PUBLICATIONS

Marques et al. "Harmonic Coding at 4.8 KB/S," Proc. IEEE Int. Conf. Acoust., Speech, Signal Processing 1:17–20, (1990).

Moulines et al. "Non parametric techniques for pitch–scale and time–scale modification of speech," Speech Communication 16:175–205 (1995).

Portnoff "Time–scale modifications of speech based on short–time Fourier analysis," IEEE Trans. Acoust., Speech, Signal Processing 29:374–390 (1981).

Puckette "Phase–locked vocoder" Proc. Proc. IEEE ASSP Workshop on App. of Sig. Proc. to Audio and Acous., New Paltz, NY (1995).

Putnam et al. "Design of Fractional Delay Filters Using Convex Optimization," Proc. IEEE ASSP Workshop on App. of Sig. Proc. to Audio and Acous., New Paltz, NY (1997).

Serra et al. "Spectral Modeling Synthesis: a Sound Analysis/Synthesis System Based on a Deterministic Plus Stochastic Decomposition," Computer Music J. 14:12–24 (1990).

Smith et al. "A flexible Sampling–Rate Conversion Method," Proc. IEEE Int. Conf. Acoust., Speech, Signal Processing, San Diego, CA, Mar. 1984.

Valimaki et al. "Fractional Delay Digital Filters" Proc. IEEE Int. Symposium on Circuits and Systems, Chicago, IL (1993).

Williamson et al. "Fir Approximation of Fractional Sample Delay Systems," IEEE Trans. Circuit and Syst.–II 43:269–271 (1996).

Almeida, et al., "Variable–Frequency Synthesis: An Improved Harmonic Coding Scheme," Proc. IEEE Int. Conf. Acoust., Speech, Signal Processing, pp. 27.5.1–27.5.4 (1984).

McAulay, et al., "Speech Analysis/Sythesis Based on a Sinusoidal Representation," IEEE Trans. Acoust., Speech, Signal Processing, vol. ASSP–34, No. 4, pp. 744–754 (1986).

Tassart et al., "Analytical Approximations of Fractional Delays: Lagrange Interpolators and Allpass Filters," Proc. IEEE Int. Conf. Acoust., Speech, Signal Processing, Munich, Germany (1997).

* cited by examiner

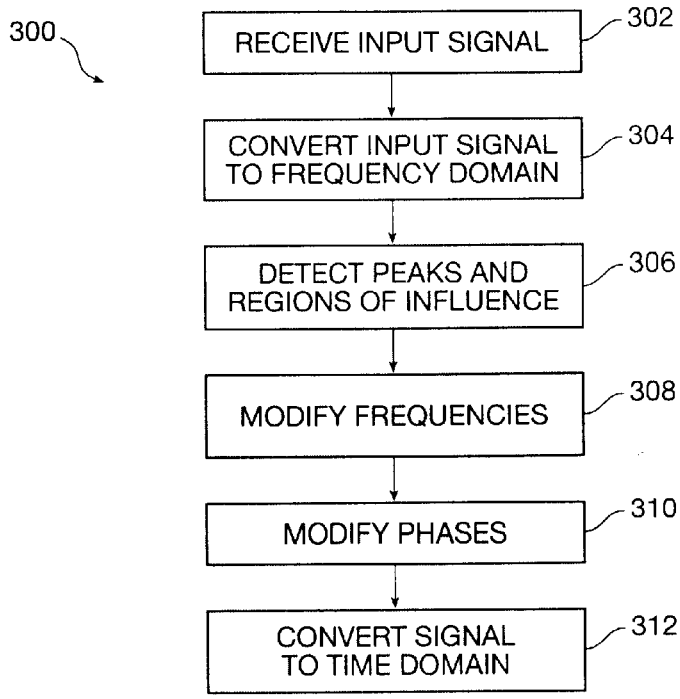
FIG. 3
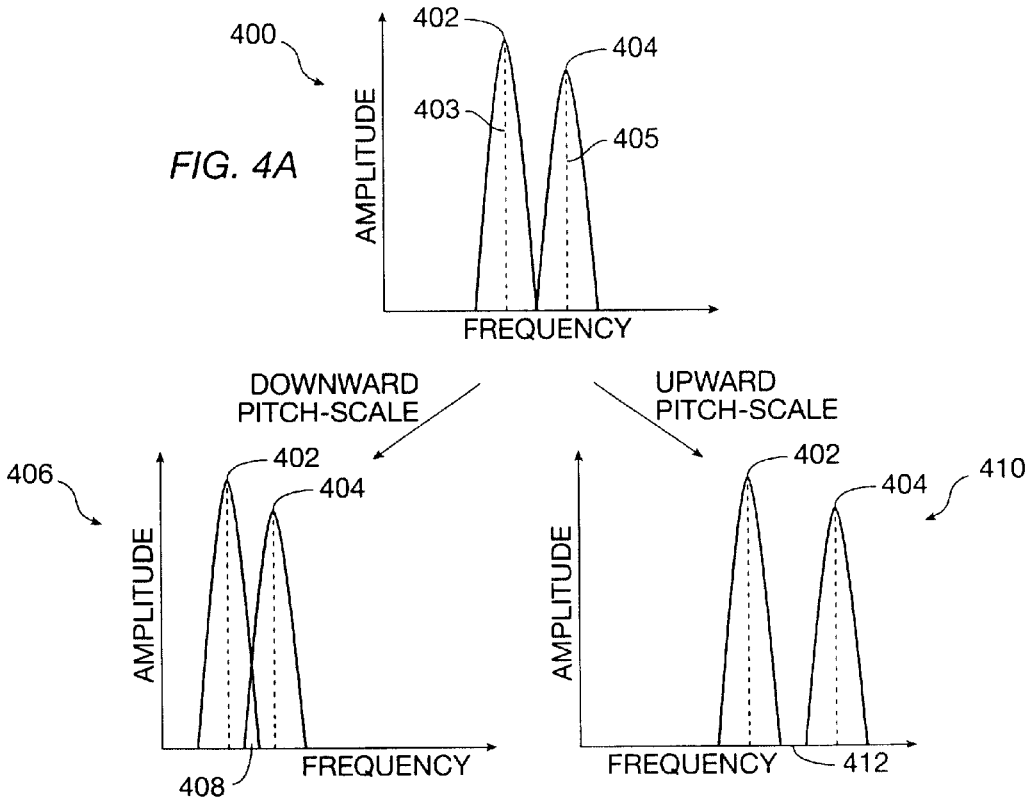
FIG. 4A
FIG. 4B
FIG. 4C

PHASE-VOCODER PITCH-SHIFTING

FIELD OF THE INVENTION

This invention relates generally to the field of signal processing, and more particularly, to a method and apparatus for pitch-shifting an information signal.

BACKGROUND OF THE INVENTION

Pitch-shifting is the operation whereby the pitch of a signal (music, speech, audio or other information signal), is altered while its duration remains unchanged. Pitch shifting may be used in audio processing, such as in music synthesis, where the original pitch of musical sounds of a known duration may be shifted to form higher or lower pitched sounds of the same duration. For example, pitch-shifting can be used to transpose a song between keys or to change the sound of a person's voice to achieve a desired special effect.

Typically, use of a phase-vocoder has always been a highly praised technique for time-scale modification of speech and audio signals. This is because the resulting signal is usually free of artifacts typically encountered in other time domain techniques. The standard way to carry out pitch-shifting using the phase-vocoder is to first perform a time-scale modification, then perform a time-domain sample rate conversion to obtain the resulting signal. For example, in order to raise the pitch of a signal by a factor of two while keeping its duration unchanged, one would use the phase-vocoder to time-expand the signal by a factor of two, leaving the pitch unchanged, and then down-sample the resulting signal by a factor of two, thereby restoring the original duration.

Unfortunately, using a phase-vocoder to perform pitch-shifting has several undesirable drawbacks. One drawback is that the processing cost per output sample is a function of the pitch modification factor. For example, if the modification factor is large, the number of mathematical operations increases correspondingly. The mathematical operations may also require complex functions, such as computing arctangents or phase unwrapping. Another drawback is that only one 'linear' pitch-shift modification can be performed at a time. This is true because the frequencies of all the components are multiplied by the same modification factor. As a result, more complex processes, like signal harmonizing or chorusing, cannot be implemented in one pass and therefore have high processing costs.

Given the limitations of the phase-vocoder, it is desirable to have a system that can perform processes like pitch-shifting in a computationally efficient manner. Such a system should also be capable of performing a variety of linear and non-linear pitch-shifting functions in a single pass. In doing so, special effects such as harmonizing and chorusing could be efficiently and easily implemented.

SUMMARY OF THE INVENTION

One aspect of the present invention solves the problems associated with pitch-shifting by providing a system for pitch-shifting signals in the frequency domain. This eliminates the expensive time domain resampling stage and allows the computational costs to become independent of the pitch modification factor. Unlike the prior art, the system does not require the calculation of arctangents nor phase unwrapping when modifying the phase in the frequency domain, thus achieving a significant reduction in the number of computations. For example, in one embodiment, the system supports a 50% overlap (as opposed to a 75% overlap in standard implementations), which cuts the computational cost by a factor of 2.

In an embodiment of the invention, a method is provided for pitch-shifting a signal by converting the signal to a frequency domain representation and then identifying a region in the frequency domain representation. The region being located at a first frequency location. Next, the region is shifted to a second frequency location to form a adjusted frequency domain representation. Finally, the adjusted frequency domain representation is transformed to a time domain signal representing the input signal with shifted pitch.

BRIEF DESCRIPTION OF THE DRAWINGS

FIG. 3 shows a processing method 300 for use with pitch shifting apparatus 100;

FIGS. 4A–C show frequency plots representative of pitch shifting in accordance with the present invention;

DESCRIPTION OF THE SPECIFIC EMBODIMENTS

Figure 1:
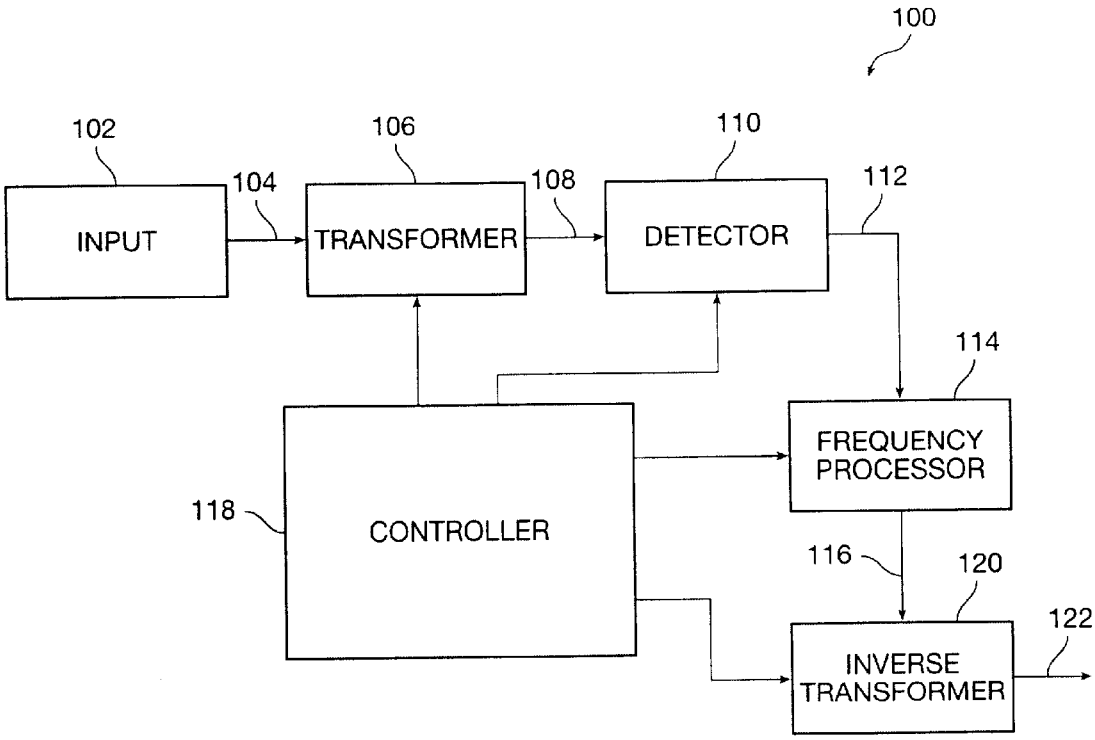
FIG. 1 shows a pitch shifting apparatus 100 constructed in accordance with the present invention.

FIG. 1 shows a pitch shifting apparatus 100 constructed in accordance with the present invention. The pitch shifting apparatus 100 comprises input module 102, transformer module 106, detector 110, frequency processor 114, inverse transformer module 120 and controller 118.

The input module 102 provides an input signal 104 to the pitch shifting apparatus 100 and may comprise a variety of input devices. For example, the input module 102 may be a storage module to store the input signal, a transceiver to receive the input signal from an external device, or a signal converter to convert another signal to form the input signal.

The transformer module 106 is coupled to the input module 102 and receives the input signal 104 from the input module 102. The transformer module 106 processes the input signal 104 to produce a frequency domain signal 108 representative of the input signal 104. The frequency domain signal 108 comprises a varying number of frequency components having associated time-varying amplitudes and phases. For example, the transformer module 106 receives a digital signal as the input signal 104 and perform a Discreet Fourier Transform (DFT) on the input signal 104 to form the frequency domain signal 108.

Figure 2:
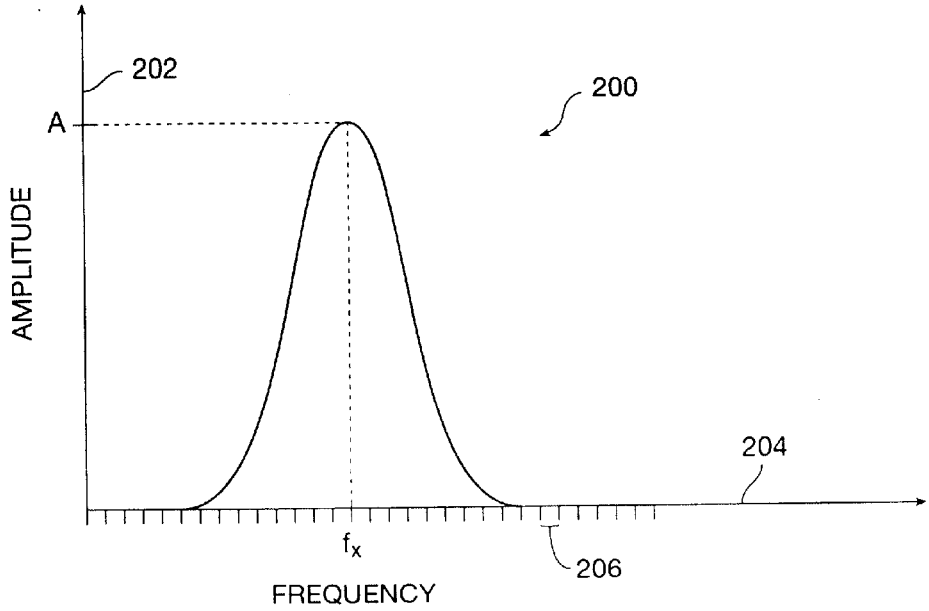
FIG. 2 shows a frequency plot 200 of a signal represented in the frequency domain.

FIG. 2 show a frequency plot 200 of amplitude values of a frequency domain signal. In the frequency plot 200, the vertical axis 202 represents the amplitude values and the horizontal axis 204 represent frequency values. The frequency values of the horizontal axis 204 are divided into frequency bins 206, also called channels. The size of the frequency bins 206 varies with the resolution of the Fourier transform used. For example, a high resolution Fourier transforms yield smaller frequency bins. The frequency plot 200 shows that the plotted amplitude values have a maximum value of A at a frequency of $f_x$. Each amplitude value represent the value over the entire bin, however, frequency plot 200 shows interpolated values from the start of one bin to the next to produce a smooth waveform.

Referring again to FIG. 1, the detector module 110 is coupled to the transformer module 104 to receive the frequency domain signal 108. The detector module 110 is capable of detecting selected conditions of the frequency domain signal 108. In one embodiment, the detector module 110 determines signal peaks and associated regions of influence in the frequency domain signal 108 that are representative of signals to be pitch-shifted. The regions of influence represent sound characteristics associated with the detected peaks. The detector module 110 uses a variety of techniques to determine the signal peaks and associated regions of influence surrounding the signal peaks. For example, determining bin values where maximums or minimums occur, or curve fitting over several bins to determine a peak value and its exact location.

The frequency processor 114 is coupled to the detector 10 to receive the frequency domain signal 108, the detected peaks and the associated regions of influence. The frequency processor 114 performs a variety of frequency processing functions to form an adjusted frequency domain signal 116. For example, one frequency processing function performs pitch-shifting while other frequency processing functions perform such processes as signal harmonizing and chorusing.

The controller 118 is coupled to the transformer module 106, the detector 106, the frequency processor 114 and the inverse transformer 120. The controller 118 controls operation of the various components of the pitch shifting apparatus 100. For example, the controller 118 controls operation of the transformer module 106 to determine parameters like transform size and frequency resolution. The controller 118 also controls operation of the detector 110 so that various types of peak detection are possible including detecting minimum values, maximum values and estimations resulting from curve fitting techniques or interpolations. The controller 118 further controls operation of the frequency processor 114 to control the performance of a variety of frequency processing functions. For example, pitch-shifting, chorusing and harmonizing are frequency processing functions that can be controlled by the controller 118. These functions can be accomplished by shifting, copying, replicating or otherwise processing the frequency domain signal 108.

The inverse transformer module 120 is coupled to the frequency processor 114 to receive the adjusted frequency domain signal 116 and transform it to a time domain signal 122. As a result, the pitch shifting apparatus 100 receives signals from the input module 102, performs a wide range of processing functions in the frequency domain and then converts the processed signals to the time domain for further use.

FIG. 3 shows processing method 300 for pitch-shifting a signal in accordance with the present invention. At block 302, an input signal is received for processing. The input signal may be an analog signal that is digitized to form a sampled input signal or the input signal may be a sampled input signal stored in a memory and read out for processing. In another embodiment, a real time input signal comprised of real-time samples is received or, in still another embodiment, an analog signal is received and digitized on-the-fly to produce real-time samples. Reception and processing of signals to produce the input signal 104 occurs at the input module 102 of the pitch shifting apparatus 100.

At block 304, the input signal 104 from the input module 102 is converted to the frequency domain using well know Fourier transform processes at the transformer module 106. For example, if the sampled input signal is expressed as:

$$x(n)=e^{iwn+\phi}$$

then a short term signal at time $t_a^u$ can be expressed as:

$$x^u(n)=e^{iw(n+t_a^u)}h(n)$$

where h(n) is an analysis window and the corresponding Fourier transform is:

$$X(t_a^u,\Omega_k)=e^{i\phi+wt_a^u}H(\Omega_k-w)$$

where $H(\Omega)$ is the Fourier transform of the analysis window h(n). A hop size can be defined as the time interval between two consecutive analyses $t_a^{u+1}-t_a^u$. The hop size is usually ½ or ¼ of the FFT size, so that consecutive analyses overlap by 50% or 75% respectively.

At block 306, the frequency domain signal 108 resulting from the Fourier transform contains frequency components of varying amplitudes and phases. For example, the amplitudes of the frequency domain signal can be plotted as a waveform depicting amplitude values versus corresponding frequency values or bins. Signals to be pitch-shifted can be identified by amplitude peaks in the frequency domain signal. For example, one technique to identify a peak consists of identifying frequency bins wherein the amplitude value associated with the frequency bin is larger than the amplitude values associated with that of two neighbor bins on the right and two neighbor bins on the left. Once the peaks are identified, it is also possible to identify regions of influence located around each peak. The regions of influence represent sound qualities associated with the detected peak. The boundary between two adjacent regions of influence can be determined in a variety of techniques. In one technique, the boundary can be set at the frequency bin centered between the two adjacent peaks associated with the regions of influence. In another technique, the boundary can be set to the frequency bin having the lowest amplitude value between two adjacent peaks. The detector 110 performs the techniques above to determine the peaks and regions of influence in the frequency domain representation.

At block 308, modification of the peaks and regions of influence identified at block 306 occurs. Because every peak can be shifted to an arbitrary frequency location, it is easy to obtain a variety of special effects. For example, to pitch-shift a signal by a ratio A, amplitude values associated with the frequency of the peak (w) and corresponding region of influence are shifted in frequency by:

$$\Delta w=\beta w-w$$

However, only an approximate value of w is know, namely $\Omega_{k0}$, where $k_0$ is the peak channel or bin. Since the channel may vary in size, Δw may only be approximately known. This may be a problem unless the FFT size is large enough that $\Omega_{k0}$ is a good enough estimate of w. If this is not the case, for example if a very precise amount of pitch shifting is desirable, then the estimate of w can be refined by use of a quadratic interpolation, whereby a parabola is fitted to the peak channel and its associated neighbor channels. The maximum of the parabola is taken to indicate the true peak frequency.

A variety of processing effects are possible in a single step by shifting the frequency of selected peaks. For example, a harmonizing effect results when a selected peak is copied to several locations as determined by harmonizing ratios. For example, to harmonize a melody to a fourth and a seventh, each peak in the melody is copied to two other frequency regions, one corresponding to the ratio of $2^{5/12}$, and the other to the ratio of $2^{10/12}$. Chorusing is also possible by using harmonizing ratios close to 1.

In another embodiment, other effects can be obtained by using a ratio of β, where β itself is a function of frequency. For example, setting $\beta(w)=\beta_0+\gamma w$ turns a harmonic signal (one where harmonic frequencies exist that are integer multiples of a fundamental frequency) into an inharmonic signal, or vice versa. In another embodiment, the amplitude values associated with the frequencies of the frequency domain representation can be shuffled around to completely alter the spectral content of the signal. Contrary to prior methods, the present invention allows the above complex processing effects to be achieved in a single pass and in real-time. Frequency processor 114 performs the frequency shift operations under control of controller 118.

Once the amount of frequency shift Δw , for a desired pitch shifting effect is known, two separate cases arise depending on whether or not Δw corresponds to an integer number of frequency channels. The first case occurs when Δw does correspond to an integer number of frequency channels. In this case, no interpolation is required, so the frequency shift is just a matter of shifting the amplitude values of the Fourier transform from one set of channels to another. One result of the shifting process is that two consecutive regions of influence may overlap, or conversely, become more disjoint after being shifted. If the regions overlap, the overlapping portions can simply be added together. If the regions become more disjoint, null spectral values can be inserted between the resulting disjoint regions.

FIGS. 4A, 4B and 4C show frequency plots illustrating pitch shifting a signal an integer number of frequency channels in accordance with the present invention. In FIG. 4A, the frequency plot 400 comprises a first region of influence 402 and a second region of influence 404. Each region of influence contains an identified peak. For example, the first region of interest 402 contains a first peak 403 and the second region of influence 404 contains a second peak 405.

FIG. 4B illustrates a process of downward pitch-shifting where the two regions of influence (402, 404), and their associated peaks (403, 405), are shifted down in frequency with the result shown in frequency plot 406. The shifting process forms an overlap region 408 wherein the overlapped portions of each region can simply be added together.

FIG. 4C illustrates a process of upward pitch-shifting where the two regions of influence (402, 404) and their associated peaks (403, 405), are shifted up in frequency with the result shown in frequency plot 410. In this case the two regions of influence become more disjoint. To accommodate this, null spectral values 412 are inserted into the disjoint region.

In another case of pitch shifting, Δw does not correspond to an integer number of frequency channels. This case requires interpolation of the spectrum between the discrete frequency bins. To do this, one technique involves using linear interpolation where both the real and imaginary part of the spectrum are linearly interpolated between frequency bins so that precise frequency shifting can be performed. However, the linear interpolation techniques can introduce undesirable modulation in the resulting time domain signal. In the worst case of linear interpolation, a ½ bin frequency shift introduces an attenuation at the beginning and end of the short-term signal. Specifically, the ½ bin shifted version of $X(t_a^u, \Omega_k)$ is given by the expression:

$$Y(t_a^u,\Omega_k)=0.5(X(t_a^u,\Omega_k)+(X(t_a^u,\Omega_{k+1}))$$

which yields:

$$y^u(n)=x^u(n)\cos \pi n/N-N/2\leq n\leq N/2$$

where N denotes the size of the FFT. As a result, the short term signal is amplitude modulated by a cosine function. Assuming that the analysis and synthesis windows are designed for perfect reconstruction, then the output signal y(n) will also exhibit amplitude modulation.

Figure 5A:
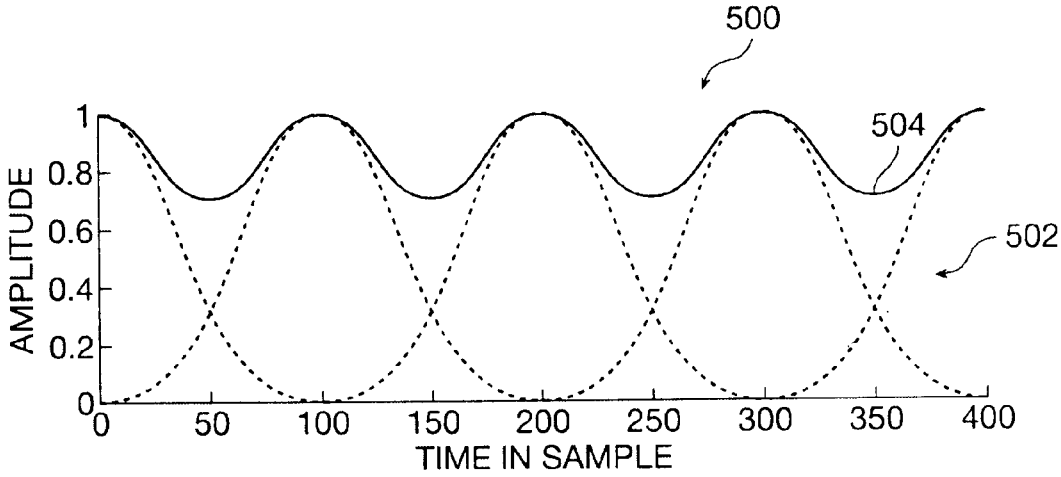
FIG. 5A shows time domain amplitude modulation for 50% overlap.

FIG. 5A shows time domain waveform 500 illustrating the modulation effect caused by frequency domain linear interpolation for a ½ bin shift. The waveform 500 corresponds to a 50% overlap using a Hanning input window and a rectangular synthesis window. Individual cosine modulated output windows 502 representing h(n)g(n) are shown as well as resulting overlap-add modulation 504.

Figure 5B:
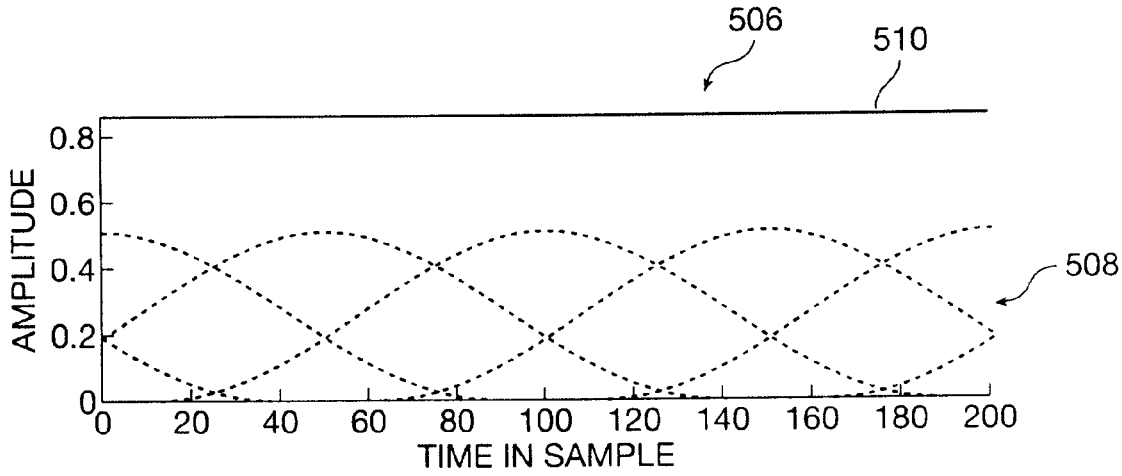
FIG. 5B shows time domain amplitude modulation for 75% overlap.

FIG. 5B shows time domain waveform 506 illustrating the modulation effect caused by frequency domain linear interpolation for a ½ bin shift corresponding to a 75% overlap using a Hanning input window and a rectangular synthesis window. Individual cosine modulated output windows 508 representing h(n)g(n) are shown as well as resulting overlap-add modulation 510.

The modulation illustrated in FIGS. 5A and 5B introduces sidebands in the frequency domain whose levels are a function of the window type and the overlap. For example, an input sinusoid at 50% overlap will have sidebands approximately 21 dB down from the sinusoid's amplitude. Since this level would most likely be audible to a listener, 50% overlap would not produce the best results when using linear interpolation. At 75% overlap, the sidebands drop to approximately 51 dB below the amplitude of the sinusoid's. Since this level would be barely audible if at all, 75% overlap produces the better result when using linear interpolation. However, as shown above, 50% overlap produces excellent results for integer numbers of bin shifts.

Figure 6A:
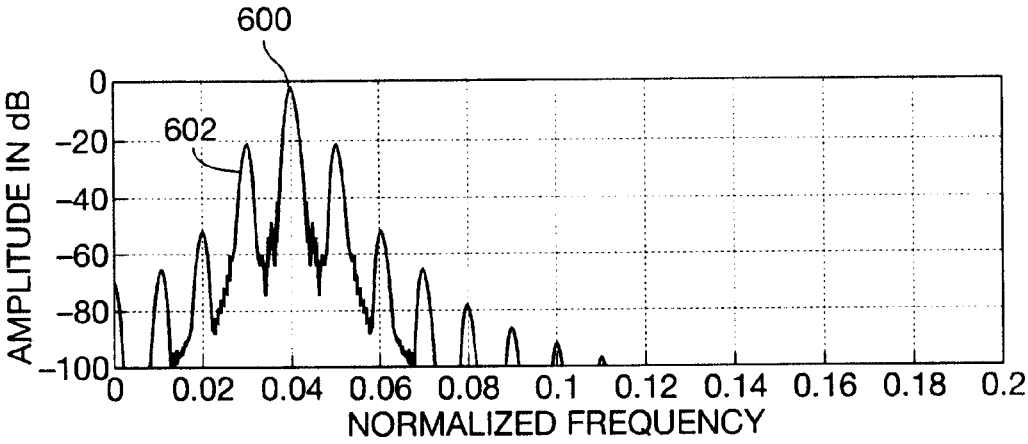
FIG. 6A shows frequency domain side lobes for 50% overlap.

FIG. 6A shows waveform 600 illustrating modulation in the frequency domain as a result of using 50% overlap. With the frequency normalized to equal 0.04, sideband 602 is approximately 21 dB below the peak frequency. In other embodiments it may still be possible to use 50% overlap while reducing the sidebands to inaudible levels. This may be achieved by using an FFT size larger than the analysis window or a higher quality interpolation scheme, such as an all-pass or high-order Lagrange interpolation scheme. However, different interpolation schemes may have increased processing costs to offset the savings achieved by using 50% overlap instead of 75% overlap.

Figure 6B:
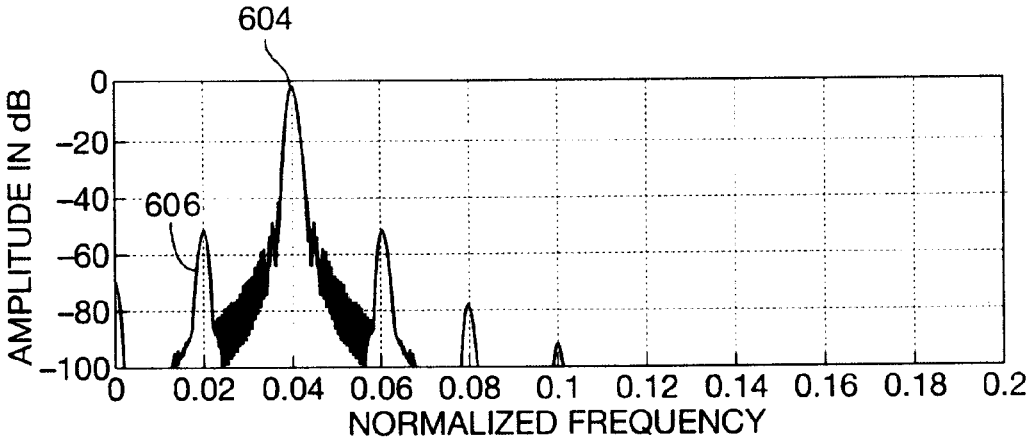
FIG. 6B shows frequency domain side lobes for 75% overlap.

FIG. 6B shows waveform 604 illustrating modulation in the frequency domain as a result of using 75% overlap. With the frequency normalized to equal 0.04, sideband 606 is approximately 51 dB below the peak frequency. At this level, sideband 606 would be virtually inaudible.

Referring again to FIG. 3, at block 310 the phases of the modified frequencies are adjusted in order for the output of the short term signals to overlap coherently. In the case of frequency shifts limited to an integer number of frequency bins and a hop size limited to a submultiple of the FFT size, the phase adjustment can be derived from the expressions:

$$\theta^u=\theta^{u-1}+\Delta w^u R_0 \quad (1)$$

$$\Delta w^u=2\pi n/N$$

where N is the FFT size, n is an integer and $R_0$=N/m where m is an integer. As a result, the expression:

$$\Delta w^u R_0=n2\pi/m$$

is always a multiple of 2π/m. For example, if the overlap is 50%, then m=2 and $\Delta w^u R_0$ is always a multiple of π, and therefore, so is $\theta''$, provided $\theta^0$ is 0. Thus, no sine or cosine calculations are required, the rotation adjustment is simply change of sign. For example, the phase of each shifted frequency bin will be adjusted by a multiple of $\pi$. Therefore, only a sign change is needed when the adjustment is an odd multiple of $\pi$.

In the case of frequency shifts of non-integer numbers of frequency bins the phase adjustment can be derived from equation (1). Equation (1) requires the calculation of one cosine and sine pair per peak and one complex multiplication per channel around the peak. This is significantly simpler than prior techniques which require the additional computation of one arc tangent and one phase-unwrapping per channel.

At block 312, the frequency domain representation having shifted frequencies and adjusted phases is converted to the time domain. The time domain signal can be used in a variety of additional processes or may be input to an audio system for playback as an audio signal.

Therefore, the present invention provides a method and apparatus for pitch-shifting signals in the frequency domain. The method eliminates the expensive time domain resampling stage used by the prior art and allows the computational costs to become independent of the pitch modification factor. The method also provides a way for other signal processing, such as harmonizing or chorusing to be accomplished using a single pass thereby further increasing efficiency.

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

What is claimed is:

1. A method for pitch-shifting an audio signal comprising:

converting the signal to a frequency domain representation, wherein the frequency domain representation comprises at least one signal characteristic associated with a plurality of frequency bins;

identifying at least one frequency bin in the frequency domain representation based on the signal characteristics of multiple frequency bins;

defining a first region in the frequency domain representation associated with the at least one frequency bin, wherein the first region comprises at least a first portion of the frequency bins;

shifting the signal characteristic associated with the first region in the frequency domain representation to a second region in the frequency domain representation, wherein the second region comprises at least a second portion of the frequency bins, and therein forming an adjusted frequency domain representation; and transforming the adjusted frequency domain representation to a time domain signal.

2. The method of claim 1 wherein the signal characteristic is an amplitude characteristic and the step of identifying comprises a step of identifying the at least one frequency bin wherein the amplitude characteristic associated with the at least one frequency bin has a value greater than the amplitude characteristic associated with any of two adjacent lower frequency bins or two adjacent higher frequency bins.

3. The method of claim 2 wherein the step of defining comprises a step of defining the first region associated with the at least one frequency bin, wherein the first region is defined by a portion of the total frequency bins between the at least one frequency bin and at least a second frequency bin.

4. The method of claim 3 wherein the step of defining comprises a step of defining the first region associated with the at least one frequency bin, wherein the first region is defined by a portion of the total frequency bins between the at least one frequency bin and the at least a second frequency bin, wherein the amplitude characteristic associated with the at least a second frequency bin has a value greater than the amplitude characteristic associated with any of two adjacent lower frequency bins or two adjacent higher frequency bins.

5. The method of claim 4 wherein the step of defining comprises a step of defining the first region associated with the at least one frequency bin, wherein the first region is defined by one half of the total frequency bins between the at least one frequency bin and the at least a second frequency bin.

6. The method of claim 4 wherein the step of defining comprises a step of defining the first region associated with the at least one frequency bin, wherein the first region is defined by at least a third frequency bin having an amplitude characteristic with a minimum value as compared to other frequency bins between the at least one frequency bin and the at least a second frequency bin.

7. The method of claim 2 wherein the step of shifting comprises a step of shifting the amplitude characteristic associated with the first region in the frequency domain representation an integer number of frequency bins to the second region in the frequency domain representation, wherein the second region comprises at least a second portion of the frequency bins, and therein forming the adjusted frequency domain representation.

8. The method of claim 7 wherein the step of shifting further comprises a step of adjusting a phase characteristic associated with each bin in the first region by a multiple of $\pi$.

9. The method of claim 2 wherein the step of shifting comprises a step of shifting the amplitude characteristic associated with the first region in the frequency domain representation a non-integer number of frequency bins to the second region in the frequency domain representation, wherein the second region comprises at least a second portion of the frequency bins, and therein forming the adjusted frequency domain representation.

10. The method of claim 9 wherein the step of shifting comprises a step of shifting the amplitude characteristic associated with the first region in the frequency domain representation a non-integer number of frequency bins to the second region in the frequency domain representation using a linear interpolation algorithm, wherein the second region comprises at least a second portion of the frequency bins, and therein forming the adjusted frequency domain representation.

11. The method of claim 2 wherein the step of shifting comprises a step of copying the amplitude characteristic associated with the first region in the frequency domain representation to the second region in the frequency domain representation, wherein the second region comprises at least a second portion of the frequency bins, and therein forming the adjusted frequency domain representation.

12. Apparatus for pitch-shifting an audio signal comprising:

a transform module having logic to receive the signal and to produce a frequency domain representation of the signal, wherein the frequency domain representation comprises at least one signal characteristic associated with a plurality of frequency bins;

a detector coupled to the transform module having logic to receive the frequency domain representation of the signal and to detect at least one frequency bin from the plurality of frequency bins based on the signal characteristics of multiple frequency bins, the detector further comprising logic to identify a first region comprising at least a first portion of the frequency bins associated with the at least one frequency bin; a frequency processor coupled to the detector and having logic to receive the frequency domain representation and to shift the signal characteristic associated with the first region to a second region, wherein the second region comprises at least a second portion of the frequency bins and therein forming an adjusted frequency domain representation; and an inverse transform module coupled to the frequency processor and having logic to receive the adjusted frequency domain representation and to transform the adjusted frequency domain representation to a time domain signal.

13. The apparatus of claim 12 wherein the signal characteristic is an amplitude characteristic and the detector further comprises logic to detect the at least one frequency bin, wherein the amplitude characteristic associated with the at least one frequency bin has a value greater than the amplitude characteristic associated with any of two adjacent lower frequency bins or two adjacent higher frequency bins, respectively.

14. The apparatus of claim 13 wherein the detector further comprises logic to detect at least a second frequency bin, wherein the amplitude characteristic associated with the at least a second frequency bin has a value greater than the amplitude characteristic associated with any of two adjacent lower frequency bins or two adjacent higher frequency bins, respectively.

15. The apparatus of claim 14 wherein the detector further comprises logic to identify the first region, wherein a boundary of the first region is defined by one half of the total frequency bins between the at least one frequency bin and the at least a second frequency bin.

16. The apparatus of claim 14 wherein the detector further comprises logic to identify the first region, wherein a boundary of the first region is defined by at least a third frequency bin, wherein the at least a third frequency bin has an amplitude characteristic with a minimum value relative to other frequency bins between the at least one frequency bin and the second frequency bin.

17. The apparatus of claim 13 wherein the frequency processor includes logic to shift the amplitude characteristic associated with the first region by an integer number of frequency bins to the second region, wherein the second region comprises at least a second portion of the frequency bins, and therein forming the adjusted frequency domain representation.

18. The apparatus of claim 17 wherein the frequency processor includes logic to adjust a phase characteristic associated with each bin in the first region by a multiple of $\pi$.

19. The apparatus of claim 13 wherein the frequency processor includes logic to shift the amplitude characteristic associated with the first region by a non-integer number of frequency bins to the second region, wherein the second region comprises at least a second portion of the frequency bins and therein forming an adjusted frequency domain representation.

20. The apparatus of claim 19 wherein the frequency processor includes logic to shift the amplitude characteristic associated with the first region by a non-integer number of frequency bins to the second region by using an interpolation algorithm, and therein forming the adjusted frequency domain representation.

21. The apparatus of claim 13 wherein the frequency processor comprises logic to copy the amplitude characteristic associated with the first region to the second region, wherein the second region comprises at least a second portion of the frequency bins, and therein forming the adjusted frequency domain representation.

22. A method for pitch-shifting an audio signal comprising:

converting the audio signal to a frequency domain representation, wherein the frequency domain representation comprises amplitude and phase values associated with a plurality of frequency bins;

identifying at least one peak in the frequency domain representation based on the amplitude values of multiple frequency bins;

defining a region of frequency bins associated with the at least one peak;

shifting the region to a new region in the frequency domain representation, therein forming an adjusted frequency domain representation; and transforming the adjusted frequency domain representation to a time domain signal.

23. The method of claim 22 wherein the step of identifying comprises a step of identifying the at least one peak in the frequency domain representation, wherein the at least one peak has an amplitude value greater than the amplitude value of any of two adjacent lower frequency bins or two adjacent higher frequency bins.

24. The method of claim 22 wherein the step of defining comprises a step of defining the region of frequency bins for the at least one peak, wherein the region is defined by one half the number of frequency bins between the at least one peak and at least a second peak.

25. The method of claim 22 wherein the step of defining comprises a step of defining the region of frequency bins for the at least one peak, wherein the region is defined by the frequency bin located between the at least one peak and at least a second peak and having a minimum amplitude value.

26. The method of claim 22 wherein the step of shifting comprises a step of shifting the region an integer number of frequency bins to the new region in the frequency domain representation, therein forming the adjusted frequency domain representation.

27. The method of claim 26 wherein the step of shifting further comprises a step of adjusting a phase characteristic associated with each bin in the region by a multiple of $\pi$.

28. The method of claim 22 wherein the step of shifting comprises a step of shifting the region a non-integer number of frequency bins to the new region in the frequency domain representation, therein forming the adjusted frequency domain representation.

29. The method of claim 28 wherein the step of shifting comprises a step of shifting the region a non-integer number of frequency bins to the new region in the frequency domain using an interpolation algorithm, and therein forming the adjusted frequency domain representation.

30. The method of claim 22 wherein the region is a first region and the step of shifting comprises steps of:

identifying at least a second peak in the frequency domain representation;

defining a second region of frequency bins associated with the at least a second peak; and shifting the first region and the second region a different number of frequency bins to form the adjusted frequency domain representation.

31. The method of claim 22 wherein the step of shifting comprises a step of copying the region to the new region in the frequency domain, and therein forming the adjusted frequency domain representation.

* * * * *